United States Patent [19]

Pompa

[11] Patent Number: 4,836,545

[45] Date of Patent: Jun. 6, 1989

[54] TWO PIECE METALLIC AND COMPOSITE GOLF SHAFT

[76] Inventor: J. Benedict Pompa, 4805 U.S. Alt. 19 N., #412, Palm Harbor, Fla. 34683

[21] Appl. No.: 267,849

[22] Filed: Nov. 7, 1988

[51] Int. Cl.[4] ..... A63B 53/10; D02G 3/00

[52] U.S. Cl. ..... 273/80 B; 428/377; 428/367; 273/80 R; 273/DIG. 7; 273/DIG. 23

[58] Field of Search ..... 273/80 R, 80 B, 77 R, 273/77 A, DIG. 7, DIG. 23, 73 F, 73 G, 73 H, 73 K, 80 A, 80 C, 80 D; 428/367, 377; 156/158, 171, 173, 187, 191, 296; 138/120, 155, 109, 143, 144, DIG. 2; 52/726; 43/18.1, 18.5

[56] References Cited

U.S. PATENT DOCUMENTS

| | | | |
|---|---|---|---|
| 2,809,144 | 10/1957 | Grimes | 273/80 B |
| 4,135,035 | 1/1979 | Branen et al. | 428/377 |
| 4,188,032 | 2/1980 | Yanagioka | 273/80 R |
| 4,653,216 | 3/1987 | Inoue | 43/18.5 |
| 4,725,060 | 2/1988 | Iwanaga | 273/77 A |

*Primary Examiner*—Edward M. Coven
*Assistant Examiner*—S. Passaniti

[57] ABSTRACT

A two piece metallic and composite golf shaft utilizing metal for the construction of its lower tip section, and fiber/resin composite for the construction of its upper butt section, creating a hybrid golf shaft which retains the major characteristic advantages of these two shaft materials, while being largely free of their respective disadvantages; the shaft consisting of a tubular lower metallic tip section, comprising approximately one-third of total shaft length, having parallel or tapered sides, and a plurality of diametrally expanding steps at its upper terminal end where it joins a tubular upper composite butt section of larger diameter, having a lower end which telescopingly fits into and is bonded to the inside wall of the last elongated step of the lower metallic tip section, the junction between the two sections being flush, and from whence the upper composite butt section progressively tapers outwardly to its upper terminal end.

5 Claims, 1 Drawing Sheet

FIG. 4
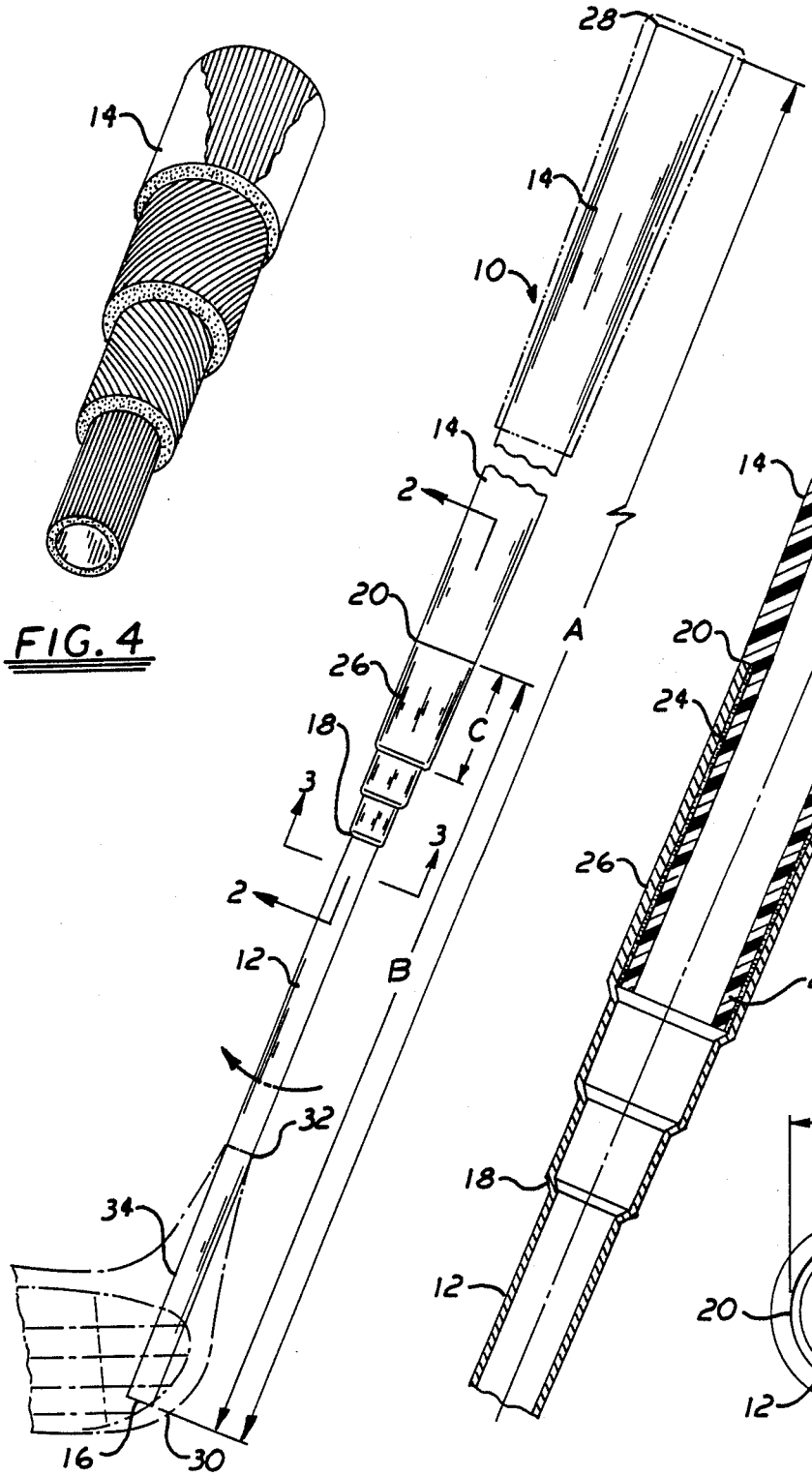
FIG. 1
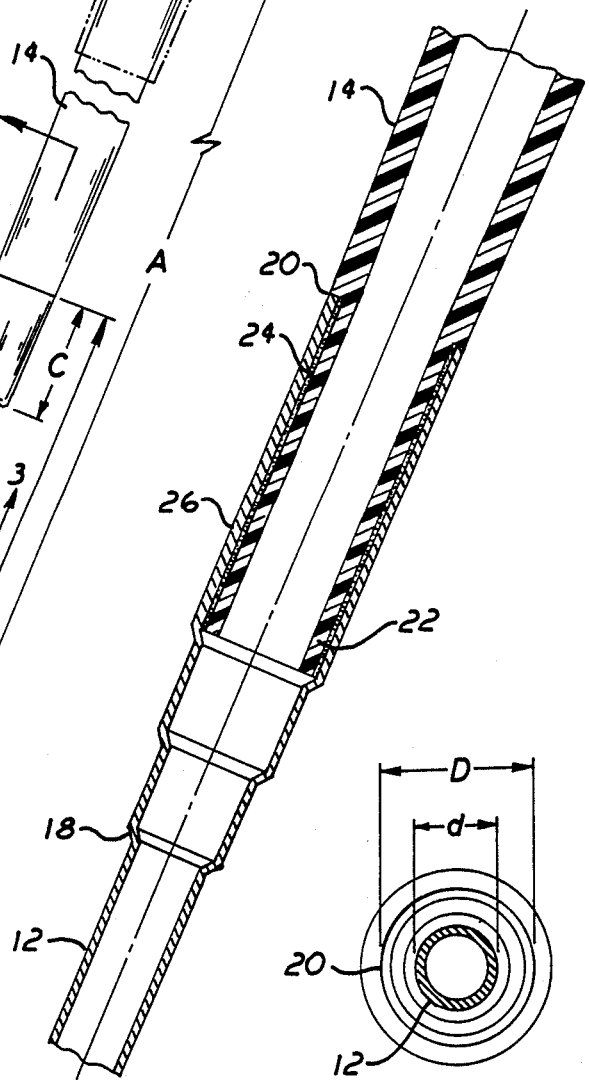
FIG. 2
FIG. 3

TWO PIECE METALLIC AND COMPOSITE GOLF SHAFT

This invention relates to a new and structurally unique two piece golf shaft which combines the two predominant golf shaft materials, metal and fiber/resin composite, in a manner as to produce a superior hybrid shaft which retains the well established advantages of both materials while being free of their respective disadvantages.

Although lightweight composite golf shafts have been available on the market for some years now, they have not as yet gained widespread acceptance. These shafts were proven to propel the golf ball farther than the standard metal shafts, but they exhibited shortcomings which have limited their acceptance mainly to female golfers and senior golfers. The most important shortcoming of composite shafts consisted of too much torqueing (twisting) of the shaft, especially in the lower tip section, which led to errant shots. Secondly, breakage of the shaft, just above the club head hosel (neck), was common. Thirdly, the "feel" of the impulse forces transmitted through the shaft to the golfer's hands was noticeably softer than the feel of metal shafts. Better golfers did not like the feel of composite shafts. These three major disadvantages plus others of lesser importance, have prevented composite shafts from achieving their full potential.

Composite shaft manufacturers have worked diligently to make their shafts perform as well as metal shafts. They now employ high modulus (stiffer) graphite fibers, high modulus boron fibers, and tungsten wire filaments, in the construction of their shafts. They have also learned to vary the longitudinal fibers and filaments and the radially wrapped fibers at different angles around the shaft to achieve different shaft flexes, torque resistance, flex points, feel, strength, etc. Many of these complicated additions and processes were made necessary by the severe demands of the tip section design.

Unfortunately these additions have increased the cost and sometimes the weight of composite shafts. Indeed, some composite shafts now weigh as much as a lightweight metal shaft (3.50–3.75 oz.). They have lost their primary light weight advantage over metal shafts and can cost ten to fifteen times as much.

Composite and metal are currently being combined in a shaft having a specially drawn non-stepped steel tube covered by a thin sheath of graphite composite. This shaft allegedly offers the overall lightness of graphite coupled with the torsional strength characteristics of steel shafts. In practice, this shaft is subject to delamination (separation) of the fibers from the steel core during play and during removal from the club head. This design also requires special tooling and does not lend itself to nomerous design variations.

The tubular two piece metallic and composite golf shaft of the instant invention utilizes metal in the construction of its lower tip section where metal is more advantageous, and fiber/resin composite construction in its upper butt section, where composite is more advantageous. The object of this split, combination construction is to create a metallic and composite golf shaft, primarily composite, which has numerous new and desireable characteristics not normally found in a totally composite shaft, such as low torque, firm feel, resistance to fracture at the club head hosel, ability to be heated at its tip and removed intact from a club head, resistance to surface chafing near its head end from constant rubbing against golf bag compartment straps or shaft tubes, and lastly, the ability to be safely bent at the top of the hosel socket to effect changes in head lie angle and face alignment.

A second major object of this invention is to provide a metallic and composite golf shaft, primarily composite, which incorporates all of the aforementioned functional improvements, with minimal increase in weight over a totally composite shaft.

Another object is to provide a metallic and composite golf shaft which offers many new variations in design characteristics.

A final object is to provide an improved golf shaft which can be more easily and more economically produced, with simplified existing tooling.

These and other advantages will become apparent in the course of the specification, reference being had to the accompanying drawings forming a part thereof, wherein like numerals refer to like parts throughout and in which:

FIG. 1 is a side elevational view of the golf shaft of the instant invention with its lower tip end fitted into the hosel portion of a golf club head;

FIG. 2 is an enlarged central sectional view through the transition area of the shaft taken on line 2—2 of FIG. 1;

FIG. 3 is a cross section taken on the transverse section line 3—3 of FIG. 1;

FIG. 4 is an enlarged fragmentary perspective cutaway view showing a typical fiber ply construction in the upper composite butt section of the golf shaft.

Referring to FIG. 1, the golf shaft of the instant invention, designated as an entity by the numeral 10, consists of two parts, a lower metallic tip section 12, and an upper composite butt section 14.

The lower metallic tip section 12 extends from its tip end 16 to upper end 20, and is denoted by dimension B in FIG. 1. It can be made of any of the standard high strength metal alloys commonly used in golf shaft construction. The sides of lower metallic tip section 12, below the first step 18, can be parallel or tapered and the diameter of its tip 34 is sized to fit standard club head hosel sockets. In general, the first step 18, depending upon the type and flex rating of the shaft, is located at a specific distance from the club head heel 30, and this distance is decreased uniformly (usually ½ inch increments) and progressively from the longest club to the shortest club in a set. For the most popular metal shafts, this distance is approximately 12 inches for a driver of medium flex having a standard 43 inch total length. A plurality of small steps, approximately ½" in length, is used to increase the diameter of the metallic tip section 12 to the junction 20 where it meets the upper composite butt section 14. The latter is made primarily of high strength fibers such as carbon-graphite. The fibers are oriented at various angles and in several layers and are bonded together with a thermosetting resin to form a rigid tube. FIG. 4 is a partial perspective cutaway view which shows the method of construction of a typical composite shaft.

The bottom end 22 of the upper composite butt section 14 is reduced in diameter, to telescopingly and slidingly fit into the inside wall of the elongated last step 26 of lower metallic tip section 12. It is bonded therein with high strength epoxy adhesive 24, as shown in FIG. 2. The length of the bonded section is denoted in FIG. 1 by dimension C and, in practice, is about 1½ inches.

The junction shoulder 20, between lower metallic tip section 12 and upper composite butt section 14, is smooth and flush. From that point, the upper composite butt section 14 tapers progressively and outwardly to a standard butt diameter at its top end 28. Using the standard 43 inch driver previously mentioned as an example, it may be seen that the proportion of the length of the lower metallic tip section 12 and the upper composite butt section 14, to total shaft length, denoted by dimension A in FIG. 1, is on the order of one-third and two-thirds respectively. This ratio may vary up or down depending upon the desired flex rating of a particular shaft, plus the desired total length of the club in which the shaft is installed.

The lower metallic tip section 12 is where the golf shaft 10 has its smallest diameter and therefore its least resistance to twisting. When the club head strikes the ball, undesireable twisting occurs because the club face is not in line with the shaft axis. Twisting of the golf shaft 10 also occurs during the down swing because of the eccentric inertial force acting on the club head. The direction of shaft twist is shown by the curved arrow in FIG. 1. Metal shafts are known to resist twisting in their tip area more effectively than composite shafts. Also metal shafts resist breakage at the club head hosel end 32 better than composite shafts. Because of these two important strength factors and other advantages previously mentioned, metal is used for this critical portion of shaft 10 of the present invention. Since length B of tip section 12 in FIG. 1 constitutes approximately only one third of the total shaft length A, the undesireable increase in total shaft weight, by substituting higher weight metal for lighter weight composite in this shorter section, is minimized. In practice it has been found to be on the order of only 10 grams. The weight differential is not great because composite shafts require substantial wall thickening in their tip section for added strength. A fortuitous benefit of this additional tip weight is that standard weighted club heads will swing-weight (balance) properly with golf shaft 10, whereas totally composite shafts require non-standard, heavier heads.

The upper composite butt section 14 is inherently twist resistant since it has a larger effective diameter throughout its length. Other factors being equal, an increased shaft diameter of only 25% at junction 20, over the lowermost tip diameter, approximately doubles twist resistance at this point. This low magnitude of diametrical enlargement does not obviate the overall tapered appearance of the entire shaft 10. FIG. 3 illustrates, in exaggerated scale, the increase between diameter (d) of the lowermost portion of lower metallic tip section 12, and the diameter (D) of upper composite butt section 14 at junction 20. The larger diameter upper composite butt section 14 does not require the addition of expensive boron fibers or heavy tungsten filaments to achieve suitable strength. It can be made entirely of less expensive, lower modulus fibers, thus preserving the inherent weight advantage and cost advantage of using such materials in this major portion of the shaft.

In practice, it has been found that the lower metallic tip section 12 contributes a more solid feel to the two piece golf shaft 10, than is found in a totally composite shaft. On the other hand, golf shaft 10 has a less harsh feel than that of a totally metallic shaft.

No special tooling is needed to build golf shaft 10. The draw operation to manufacture the lower metallic tip section 12 is actually simplified since the draw length is reduced by about two-thirds. Also, the fabrication of the upper composite butt section 14 is simplified since it is reduced in length by about one-third and no longer has a small diameter, elongated and critical tip section to contend with.

Various desireable combinations of shaft characteristics can be readily made with shaft 10 by mating flexible, medium flex, or stiff flex lower metallic tip sections with flexible, medium flex, or stiff flex upper composite butt sections.

The ability of golf shaft 10 to combine in one shaft, by means of its split construction, all the performance and ancillary advantages common to its two distinct materials and types of construction, while eliminating most, if not all, of the characteristic disadvantages of these shaft materials and types of construction, plus the ability of golf shaft 10 to be fabricated of simple, basic materials, using substantially simplified existing tooling, distinguishes this invention from prior analogous inventions and constitutes the basis for which the novelty of the present invention is predicated.

The foregoing specific embodiments of the invention are illustrative only of the principles of the invention. Numerous minor modifications and equivalents may be resorted to, falling within the scope of the invention as claimed.

What is claimed as new is as follows:

1. A hollow two piece golf shaft of circular cross section, comprising: in combination, a lower metallic tip section having parallel or tapered sides, and a plurality of diametrally expanding steps at the upper end portion of said lower metallic tip section, the length of said lower metallic tip section comprising approximately 0.25 to 0.45 of the total shaft length; an upper composite butt section of larger diameter having a lower end reduced in diameter and slidingly fitted into and bonded to the inside wall of the last step of said lower metallic tip section, said last step being elongated to approximately 1.50 inches in length, the junction between said lower metallic tip section and said upper composite butt section being flush, and from whence the upper composite butt section tapers progressively outwardly to its upper terminal end, the length of said upper composite butt section comprising approximately 0.55 to 0.75 of total shaft length.

2. In a golf shaft as defined in claim 1, and wherein said lower metallic tip section is made of steel, titanium, or aluminum.

3. In a golf shaft as defined in claim 1, and wherein said upper composite butt section is made of carbon-graphite, fiberglass or aramid fibers bonded together with a thermosetting epoxy or polyester resin.

4. In a golf shaft as defined in claim 1, said lower metallic tip section and said upper composite butt section being on a common axis.

5. In a golf shaft as defined in claim 1, said lower metallic tip section being adapted for attachment of a head on its lower end and said upper composite butt section being adapted for attachment of a hand grip on its upper end.

* * * * *